US010458758B2

(12) United States Patent
Miller et al.

(10) Patent No.: US 10,458,758 B2
(45) Date of Patent: Oct. 29, 2019

(54) ELECTRONIC AUDIBLE FEEDBACK BULLET TARGETING SYSTEM

(71) Applicants: Brian D. Miller, Louisville, KY (US); William C. Hall, Louisville, KY (US); Loren M. Miller, Louisville, KY (US)

(72) Inventors: Brian D. Miller, Louisville, KY (US); William C. Hall, Louisville, KY (US); Loren M. Miller, Louisville, KY (US)

( * ) Notice: Subject to any disclaimer, the term of this patent is extended or adjusted under 35 U.S.C. 154(b) by 0 days.

(21) Appl. No.: 14/998,572

(22) Filed: Jan. 20, 2016

(65) Prior Publication Data

US 2016/0313097 A1 Oct. 27, 2016

Related U.S. Application Data

(60) Provisional application No. 62/125,404, filed on Jan. 20, 2015.

(51) Int. Cl.
*F41J 5/14* (2006.01)
*F41J 5/056* (2006.01)

(52) U.S. Cl.
CPC ..... *F41J 5/14* (2013.01); *F41J 5/056* (2013.01)

(58) Field of Classification Search
CPC ..... F41J 5/14; F41J 5/04
See application file for complete search history.

(56) References Cited

U.S. PATENT DOCUMENTS 3,678,495 A 7/1972 Gilbert
4,351,026 A 9/1982 Phillips
4,514,621 A 4/1985 Knight et al.
4,885,725 A 12/1989 McCarthy et al.
5,095,433 A * 3/1992 Botarelli ..... F41J 5/056 235/400
5,195,752 A * 3/1993 Reeves ..... F41G 3/26 2/102
5,447,315 A * 9/1995 Perkins ..... F41J 5/056 273/348
5,551,876 A 9/1996 Koresawa et al.
5,676,548 A 10/1997 McAlpin et al.
5,823,779 A 10/1998 Muehle
5,944,317 A 8/1999 Rohrbaugh
6,109,614 A 8/2000 Ciarcia
6,196,844 B1 3/2001 Bradshaw
6,322,365 B1 11/2001 Schecter et al.
6,367,800 B1 4/2002 Sheck et al.
6,616,452 B2 9/2003 Clark et al.
(Continued)

*Primary Examiner* — Xuan M Thai
*Assistant Examiner* — Malina D. Blaise
(74) *Attorney, Agent, or Firm* — Carrithers Law Office, PLLC; David W. Carrithers

(57) ABSTRACT

A system for sensing the impact of a bullet on a target and remotely reporting the successful impact to the shooter by means of a signal transmitted from a sensor transmitter to a receiver incorporated with headphones, ear buds or an "Smart phone", tablet or other device with WIFI and/or Blue tooth capability. The sensor includes a wireless transmitter and a impact/vibration sensor such as a piezoelectric sensor. The target impact sensors can be used with various stationary targets such as metallic, plastic, film, or paper targets, but can also be used on movable targets such as body armor or removable patches worn by players in mock warfare or games such as paint ball competition to effect audible signals.

10 Claims, 9 Drawing Sheets

(56) References Cited

U.S. PATENT DOCUMENTS

| | | | | |
|---|---|---|---|---|
| 7,329,127 | B2 | 2/2008 | Kendir et al. | |
| 7,685,862 | B1 | 3/2010 | Hughes et al. | |
| 7,891,231 | B2 | 2/2011 | Song | |
| 8,336,776 | B2 | 12/2012 | Horvath et al. | |
| 8,356,818 | B2 | 1/2013 | Mraz | |
| 8,360,776 | B2 | 1/2013 | Manard et al. | |
| 8,453,368 | B2 | 6/2013 | Bockmon | |
| 8,523,185 | B1 * | 9/2013 | Gilbreath | F41J 5/056 273/348 |
| 8,561,993 | B2 | 10/2013 | Preston et al. | |
| 8,668,496 | B2 | 3/2014 | Nolen | |
| 8,672,756 | B2 | 3/2014 | Segal et al. | |
| 8,706,440 | B2 | 4/2014 | McNelis et al. | |
| 2003/0082502 | A1 | 5/2003 | Stender et al. | |
| 2003/0134700 | A1 | 7/2003 | Salva | |
| 2008/0066362 | A1 | 3/2008 | Fidlow | |
| 2010/0093255 | A1 | 4/2010 | Yamamoto | |
| 2010/0301116 | A1 | 12/2010 | Bennetts et al. | |
| 2011/0248448 | A1 | 10/2011 | Hodge | |
| 2012/0183930 | A1 * | 7/2012 | Dribben | F41G 3/26 434/19 |
| 2012/0258432 | A1 * | 10/2012 | Weissler | F41J 5/10 434/20 |
| 2013/0193645 | A1 * | 8/2013 | Kazakov | F41J 5/06 273/372 |
| 2013/0288205 | A1 | 10/2013 | Lupher et al. | |
| 2013/0337415 | A1 | 12/2013 | Huet | |
| 2013/0344461 | A1 * | 12/2013 | Tello | F41G 3/2633 434/21 |
| 2014/0038136 | A1 | 2/2014 | Hamilton | |
| 2014/0090629 | A1 | 4/2014 | Pedersen | |
| 2014/0367918 | A1 * | 12/2014 | Mason | F41J 5/04 273/371 |
| 2015/0330749 | A1 * | 11/2015 | Miller | F41J 5/14 340/539.1 |

* cited by examiner

ELECTRONIC AUDIBLE FEEDBACK BULLET TARGETING SYSTEM

CROSS REFERENCES TO RELATED APPLICATIONS

This application claims priority to U.S. Provisional Application Ser. No. 62/125,404 filed on Jan. 20, 2015 which is incorporated by reference herein in its entirety.

TECHNICAL FIELD

The present invention relates to the field of systems used to sense and report the impact of a bullet or other projectile upon a distant target especially when such impact is too small to be detected either visually or by sound.

BACKGROUND OF THE INVENTION

A BB gun, pellet gun, air soft rifle, rifle, crossbow, bow and arrow or other device for shooting projectiles is often used for target practice. When the projectile hits a metal target there is only a modest ping sound from a BB or 22, or no detectable sound from a pellet rifle such as is used in competition. Air soft guns are replica guns which use non-lethal ammunition such as plastic pellets, paper balls, and eraser chunks.

During target practice, it is desirable that a target is not consumed or ruined by a few hits. Otherwise the target must be renewed frequently. Paper bull's eye type targets are well known but are useable for only a few hits and must be scored from a vantage point nearer than the shooting position. This fact renders paper targets as undesirable. Metal targets such as shown in FIG. 3 are available in various sizes. Some are designed to flip up out of the way when hit but then must be lowered back to the shooting position. Some are provided with a top target which, when hit, resets the rest of the targets. Still, such metal targets don't give the desirable audible report.

Paint ball competition, a game wherein shooters use guns which shoot small plastic paint balls filled with paint, at one another, has become very popular. The balls rupture when they impact the target, and thus, the target is marked visibly by the paint as a hit. Sometimes, competition is done in dark areas. This can make a hit harder to see. Because competitors wear protective equipment, it is often not obvious who was hit or if anyone was hit.

DESCRIPTION OF THE RELATED ART

U.S. Pat. No. 5,095,433 by Botarelli et al for TARGET REPORTING SYSTEM which issued on Mar. 10, 1992 teaches a target with a plurality of sensors connected to a controller which transmits a message to a receiver with a loudspeaker to inform the shooter approximately where his hit occurred.

U.S. Pat. No. 7,891,231 by Song for APPARATUS FOR MONITORING AND REGISTERING THE LOCATION AND INTENSITY OF IMPACTS IN SPORTS which issued on Feb. 22, 2011 teaches a garment such a vest with pads spaced out over the vest, each pad containing an impact sensor. The sensors wirelessly transmit impact data to a receiver for registering and display of the data. The impacts result from opponents landing blows during boxing, martial arts, fencing and the like.

U.S. Pat. No. 8,356,818 by Mraz for DURABLE TARGET APPARATUS AND METHOD OF ON-TARGET VISUAL DISPLAY which issued on Jan. 22, 2013 teaches a durable target with pie shaped areas individually monitored by separate impact sensors connected to a controller. The impact sensor information is relayed to the shooter, telling him or her in which pie shaped area the hit occurred.

SUMMARY OF THE INVENTION

In accordance with the present invention, comprises or consists of a combination of software and hardware executed on a mobile device (smart phone, tablet, watch, etc.) that can monitor available inputs during firearm target shooting such as a system for large and small caliber rifles, pistols, revolvers, bb/pellet guns, airsoft guns, slingshots, etc. The system detects hits on the targets, records all relevant hit data, indicates the hits to users and accumulates hit data from single shots, rounds consisting of one or more hits detected during a user controlled period, and multiple rounds into records that provide long term training and performance information.

The present system allows users to gain audible feedback for hits on a defined target area. This eliminates the need to stop the range session to bring the target back to the user or for the user to walk down range to view target and in addition eliminates the constant delays experienced when viewing the target through the gun scope or spotting scope. Additional sensory feedback through sound greatly increases target shooter efficiency.

The target impact sensing system comprises or consists of a target with an impact sensor attached thereto, a wireless transmitter electrically connected to the impact sensor, a wireless receiver capable of receiving the wireless message with impact describing data from the transmitter and a software application for inputting data and parameters and providing an interface the transmitter and receiver. The receiver is capable of providing an impact describing audible message to a user. The impact describing audible message is interpreted from the impact describing data.

It is an object of this invention to provide an impact sensing target system which includes a small wireless impact or vibration sensor mounted on a target, with a transmitter.

It is an object of this invention to provide an impact sensing target system which includes a receiver which reports the sensor data to the shooter over headphones, ear buds or over a receiver such as an I-phone using a RF transmitter such as Bluetooth technology.

It is an object of this invention to provide an impact sensing target system wherein sensors are attached to selected areas on a vest to be worn by a paint ball competitor and wherein the impact of a paint ball or other projectile on a selected sensor causes a particular tone or other identifying signal to be transmitted to the headphones of the person who has been shot, to the person doing the shooting and others if so desired.

It is an object of this invention to provide an impact sensing target system including a plurality of individual targets of increasing size, individual sensors connected to each target, all sensors connected to a transmitter, and a receiver with headphones which identifies which target has been hit.

It is an object of this invention to provide an impact sensing target system wherein the sensor transmitter includes a small loudspeaker which creates a loud sound mimicking an exaggerated impact in the area of the target which has been hit by a projectile.

It is an object of the invention to sense impacts in different areas of a target and provide variable audible feedback which can be interpreted to determine the area or portion of a target hit.

It is an object of this invention to provide an impact sensing target system wherein the projectile is actually a beam of light from a laser gun, the sensor transmitter includes a small loudspeaker which creates a loud sound mimicking an exaggerated impact in the area of the target which has been hit by a laser beam and the receiver with headphones receives a message identifying which particular target was hit.

It is another object of the present invention to provide an software app for a phone, iPO, or other receiver wherein any desired sound can be selected or recorded or downloaded to the receiver to be played for the user upon receiving the signal from the RF sensor and transmitter.

It is another object of the present invention to provide for a sensor which may be applied to a small or large target to recreate a desirable selected sound which is not dependent upon accuracy to hit the sensor only vibrations received from the sensor mounted onto a target of selected size.

It is another object of the present invention to provide an software application, transmitter, receiver, and sensor to enable the duplication of a selected rifle caliber, or provide a volume of sound in accordance with the type or gun, or distance the target is from the shooter as well as the type of material comprising the target.

It is another object of the present invention to build a counter into the software application Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

A combination of software and hardware executing on a mobile device (smart phone, tablet) that monitors available inputs during firearm target shooting*, detects hits on targets, records all relevant hit data, indicates the hits to users and accumulates hit data from single shots, rounds and multiple rounds into records that provide long term training and performance information.

Users gain audible feedback for hits on defined target area without the need to stop range session to bring target back to user, user walk down range to view target or constant viewing through gun scope/spotting scope. Additional sensory feedback through sound greatly increases target shooter efficiency. The system can be used in any target shooting application including but not limited to large and small caliber rifles, pistols, revolvers, BB and pellet guns, airsoft guns, slingshots, etc.

Figure 1:
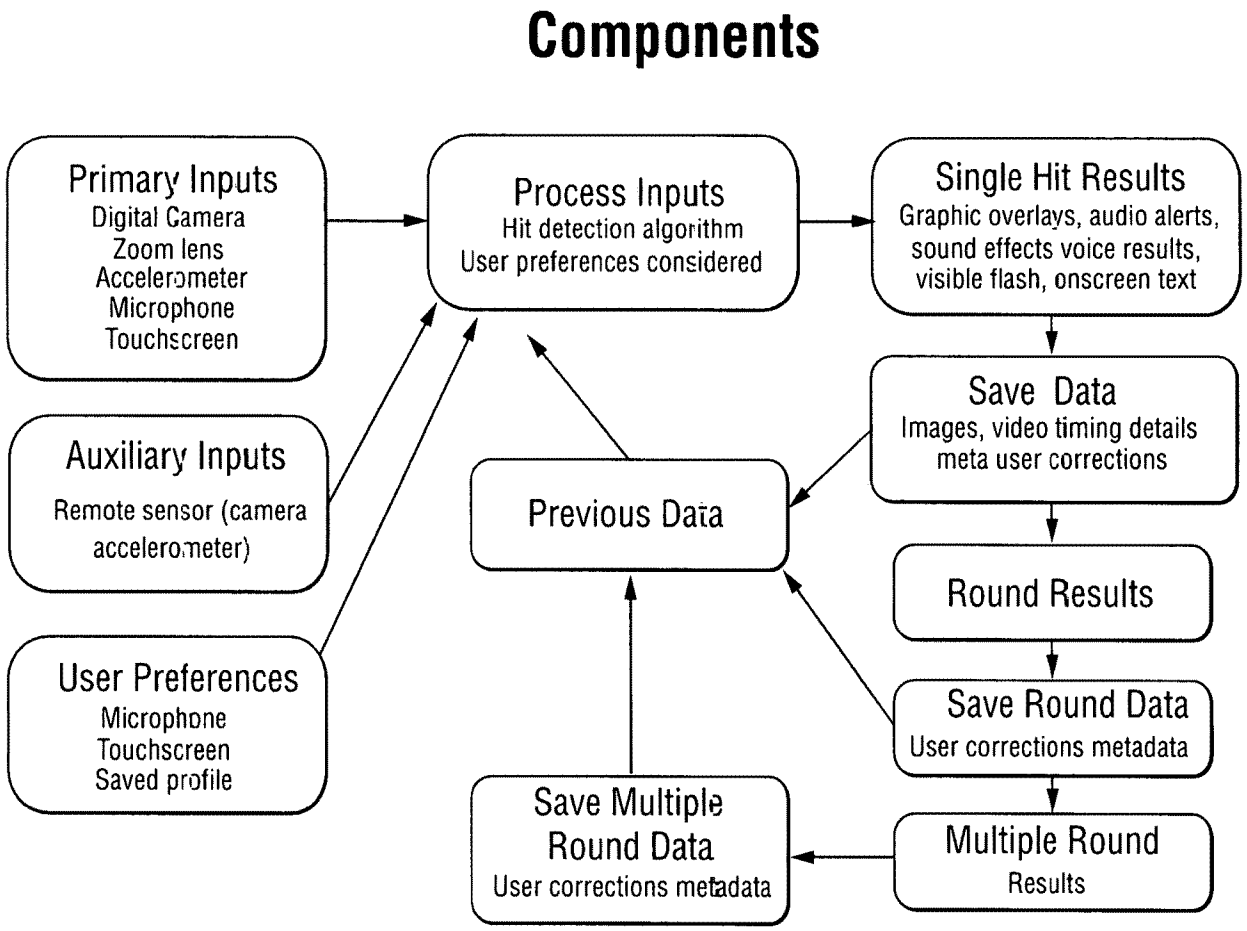
FIG. 1 shows a flow chart depicting the components of the algorithm.

As set forth in the diagram of FIG. 1, the instant system comprises the following components including a group of primary input devices including mobile devices such as a digital camera with zoom lens, an accelerometer, microphone, and touchscreen (for selecting area of interest), providing data for the process input hit detection algorithm.

Figure 2:
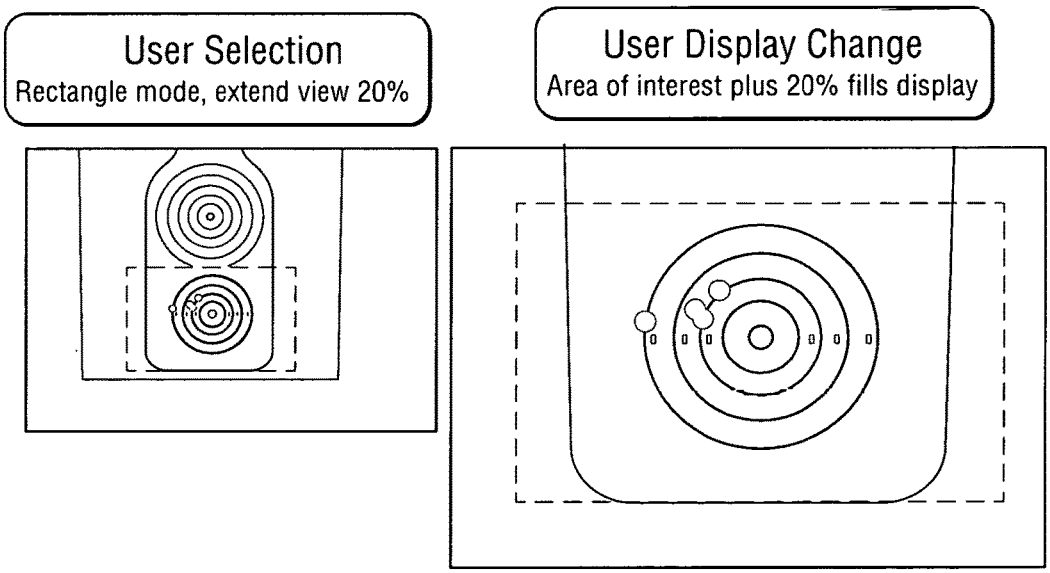
FIG. 2 is a photocopy showing user selectable area of a "hit zone" shown in the rectangle ode to extend the view 20% using camera features to zoom in an enhance an image wherein the area of interest plus 20% fills the display.

As best illustrated in FIG. 2, the user's selection of an area of interest whereby the user selectable area of the "hit zone" can be defined though various methods including camera view, touch screen defining a specific area on view of fiducials applied to target, all to represent size and shape of a desired hit zone. Optical and digital zoom can be used to enhance image size and resolution. FIG. 2 shows the user selectable area of a "hit zone" set forth in the rectangle mode to extend the view 20% using camera features to zoom in an enhance an image wherein the area of interest plus 20% fills the display.

Auxiliary inputs include a remote sensor attached to the target or near a target consist of a digital camera or accelerometer which also provides data for the process hit detection algorithm.

User preferences selected from devices such as a microphone, touchscreen device and saved profiles thereon provide additional data forth process detection algorithm. The user may enter data such as right handed or left handed shooter, distance to target, firearm make/model, caliber, bullet weight, ammo type/brand, defined hit zone, invalid hit detections, missed hit detections, environment (indoor/outdoor-temp, weather), etc.

The process inputs provide the data for the hit detection algorithm which considers the user preferences. The processing for this application is primarily image processing augmented with cues from an accelerometer, a microphone, and a touchscreen device for improved accuracy. Custom developed learning algorithms, BAYESIAN algorithms and generic algorithms increase accuracy and repeatability of hit recognition. Alternative modes support detection based on remote sensors near or attached to the target can perform low level analysis before transmitting summarized result data to the mobile device.

Figure 3:
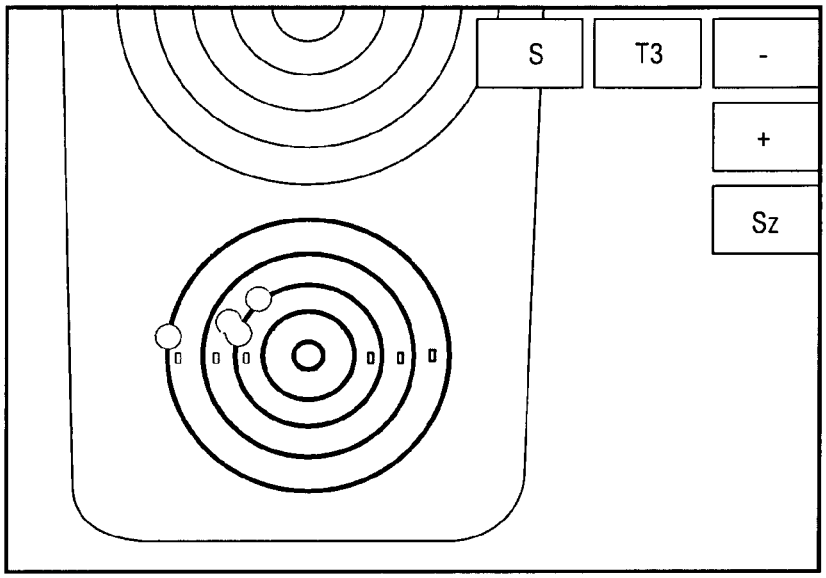
FIG. 3 is a screen shot of an application running on a development ANDROID smart phone.
Figure 4:
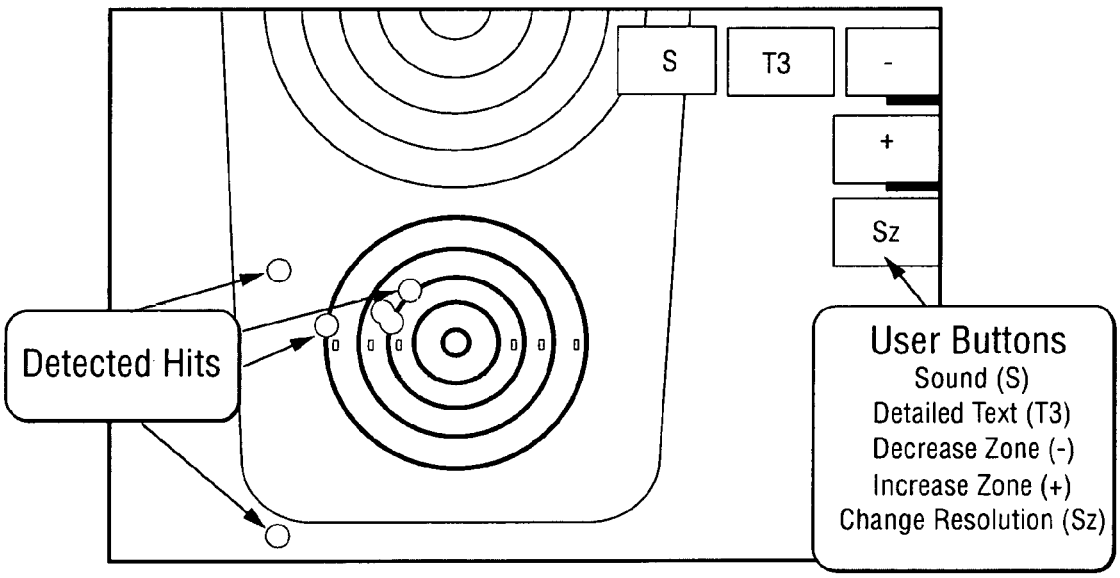
FIG. 4 is a screen shot of an application algorithm detecting real time bullet hits on target, coloring the hits, and producing sound feedback with each hit indicating detected hits, and user buttons to adjust sound, detailed text, increase or decrease the user defined hits zone, and screen resolution adjustment.
Figure 5:
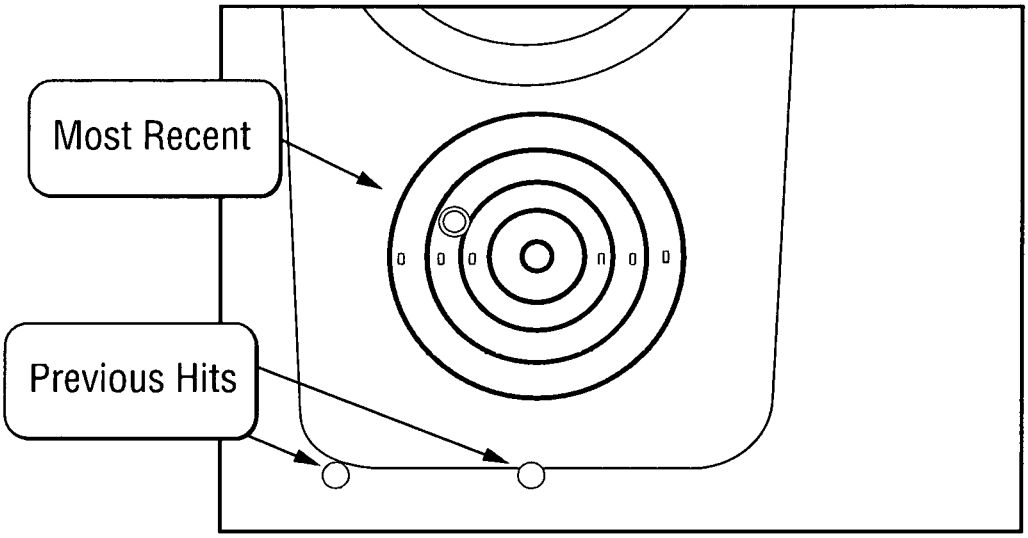
FIG. 5 is a screen shot of an application algorithm detecting the most recent bullet hit and previous bullet hits on target.
Figure 6:
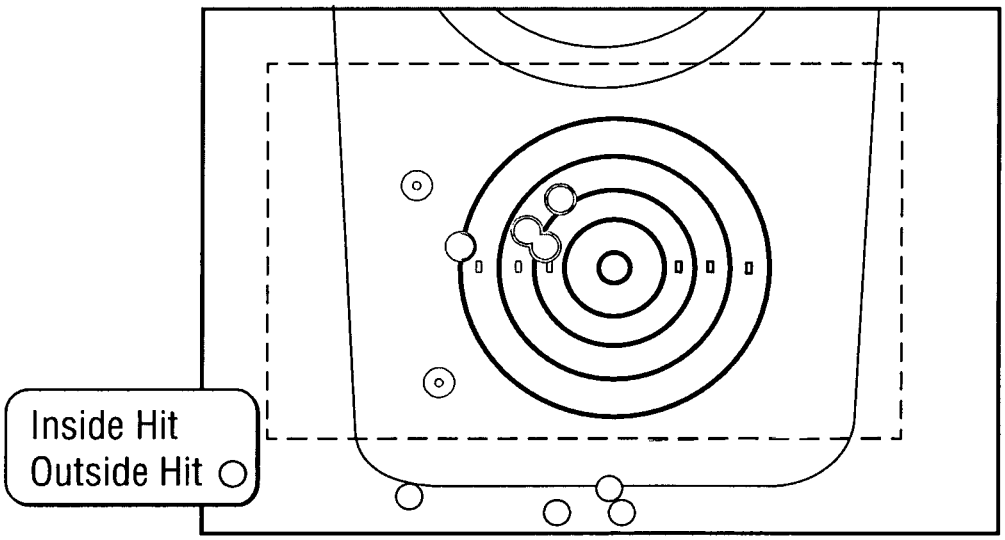
FIG. 6 is a "round view" wherein the application display shows an end of a round in which the user can quickly and easily review all of the shots, inside hits and outside hits selectively in the "hit zone"

As shown in the screen shots depicted in FIGS. 3-5, a "Single Hit" output provides an a audio which sends alerts to the user via mobile device speaker or attached BLUE TOOTH headset. An on screen text, graphic overlays on the target area, and camera flash can be used in long range applications by utilization of a reflective sticker on the target to reflect the reflection back to the user and detection device. In addition, a mirror on the phone may be used to reflect the flash back to the user's detection device. The screen shot in FIG. 3 sows the application running on an ANDROID phone, wherein the screen shot shown in FIG. 4 shows the detected hits and user buttons for adjusting the sound, detailed text, deceasing zone, increasing zone and change of screen resolution. The application algorithm detects real time bullet his on the target coloring the hits and production sound feedback with each hit. The most recent hits and previous hits can be detected, shown, or replayed whereby the algorithm detects the bullet his on the target. The most recent hit maybe a selected bright color with the previous hits displayed in a different shade or dim color. Sound feedback is user defined and varies depending on where the bullet hits the target.

Figure 7:
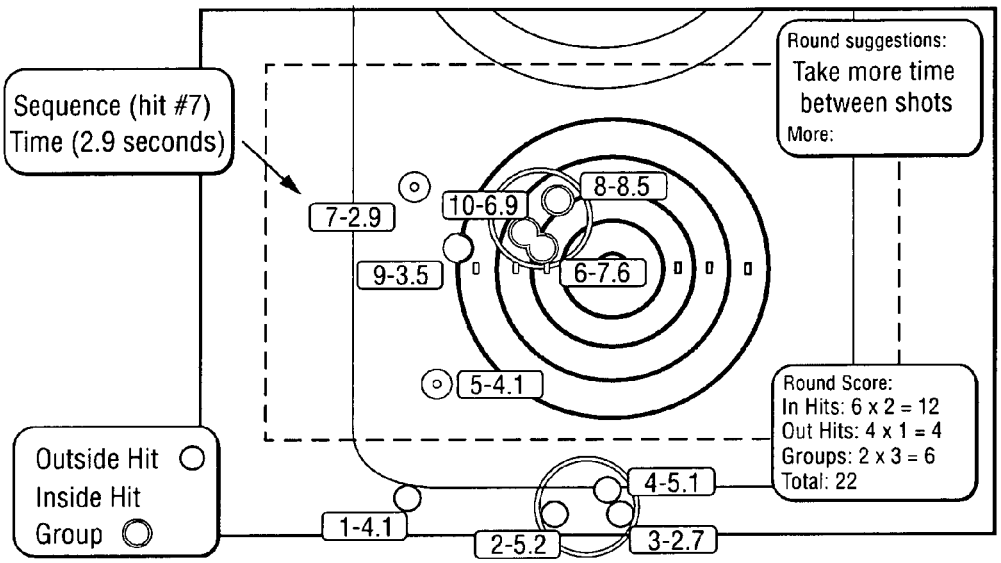
FIG. 7 shows a screen shot displaying the hits, time and sequence of shots in a round including to display of shot analysis during a user defined period showing the shot sequence, time between each shot, shots inside or outside the defined hit zone, groupings, scoring options, and constructive feedback for better shot placement and groupings.
Figure 8:
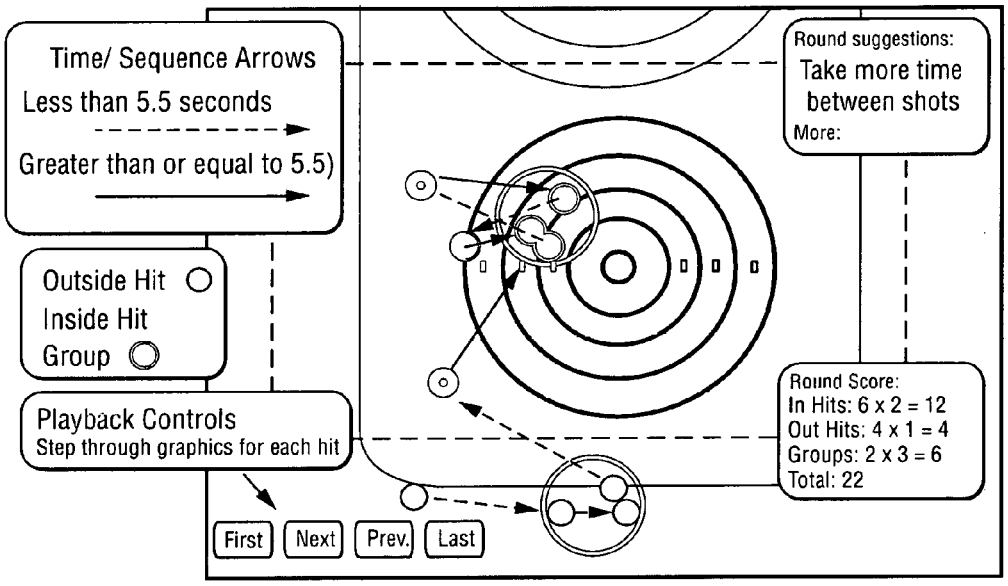
FIG. 8 shows a screen shot displaying the hits, time and sequence for a selected sequence whereby the application displays the elapsed time playback with the user controls allowing cycling through successive or previous shots for a more detailed analysis for a defined period utilizing arrows graphing show sequence, shots inside or outside of the hit zone, groupings, scoring options, and constructive feedback for better shot placement and/or groupings.
Figure 9:
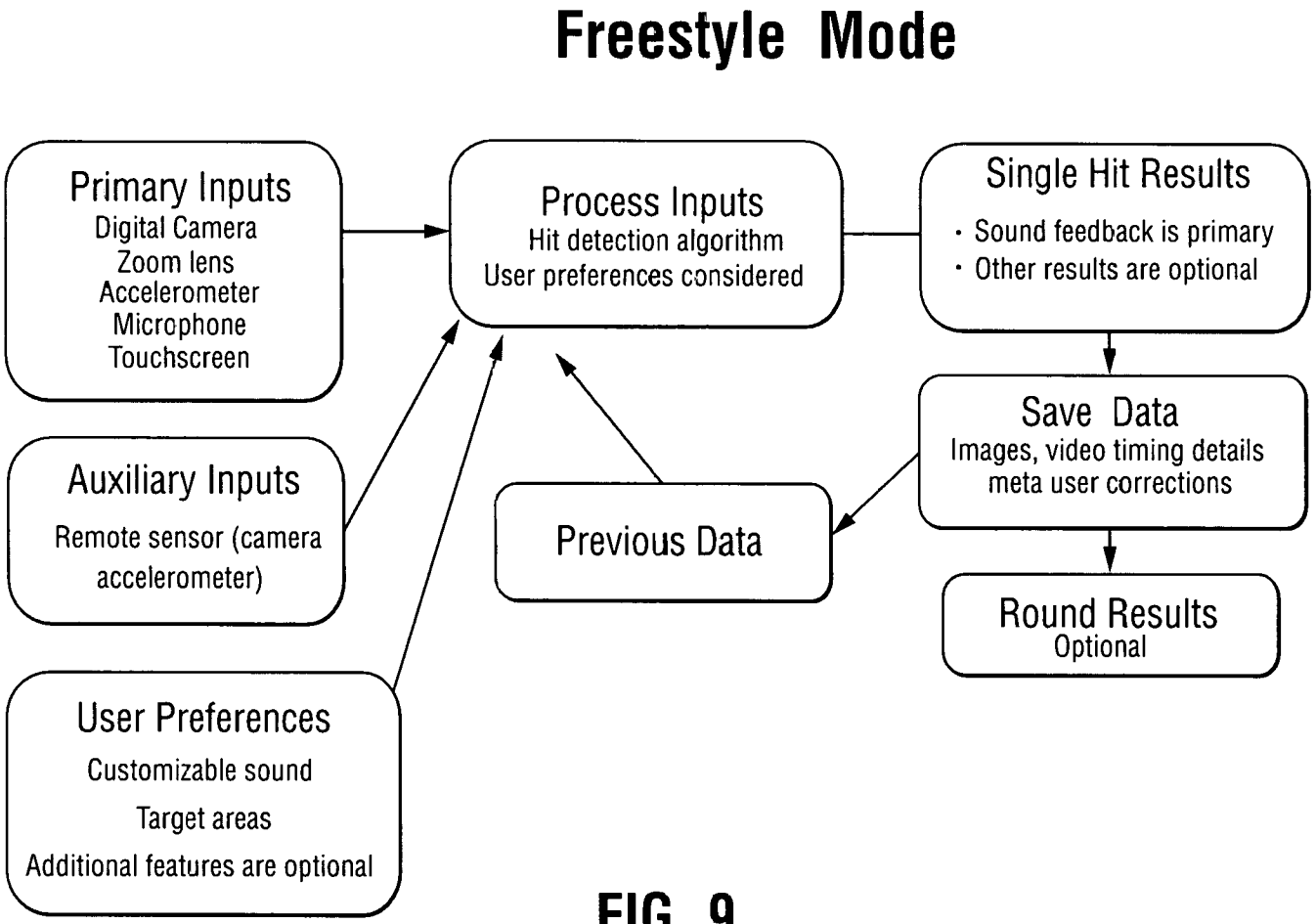
FIG. 9 shows a flow chart depicting the components of the algorithm in the Freestyle Mode.
Figure 10:
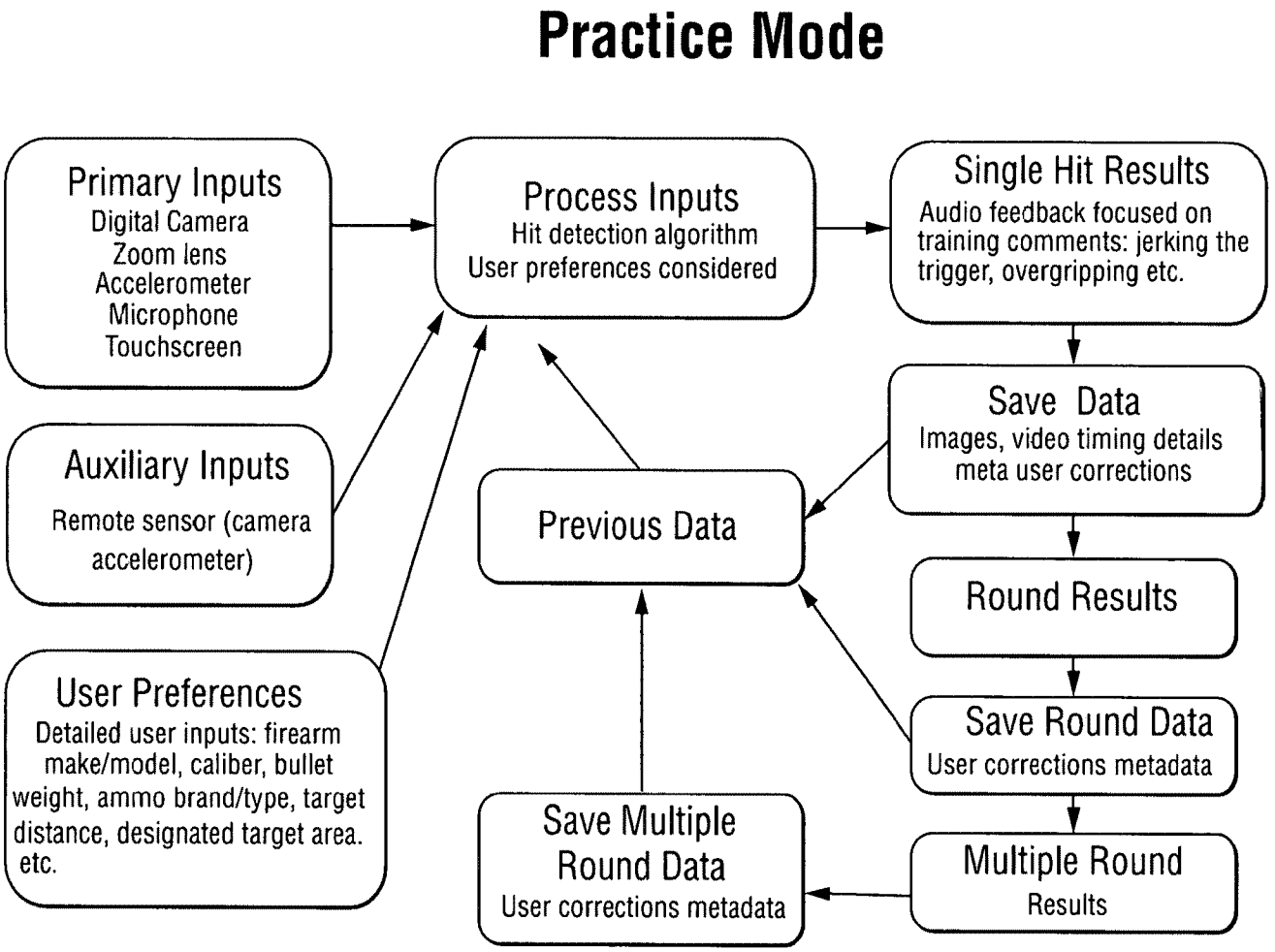
FIG. 10 shows a flow chart depicting the components of the algorithm in Practice Mode.
Figure 11:
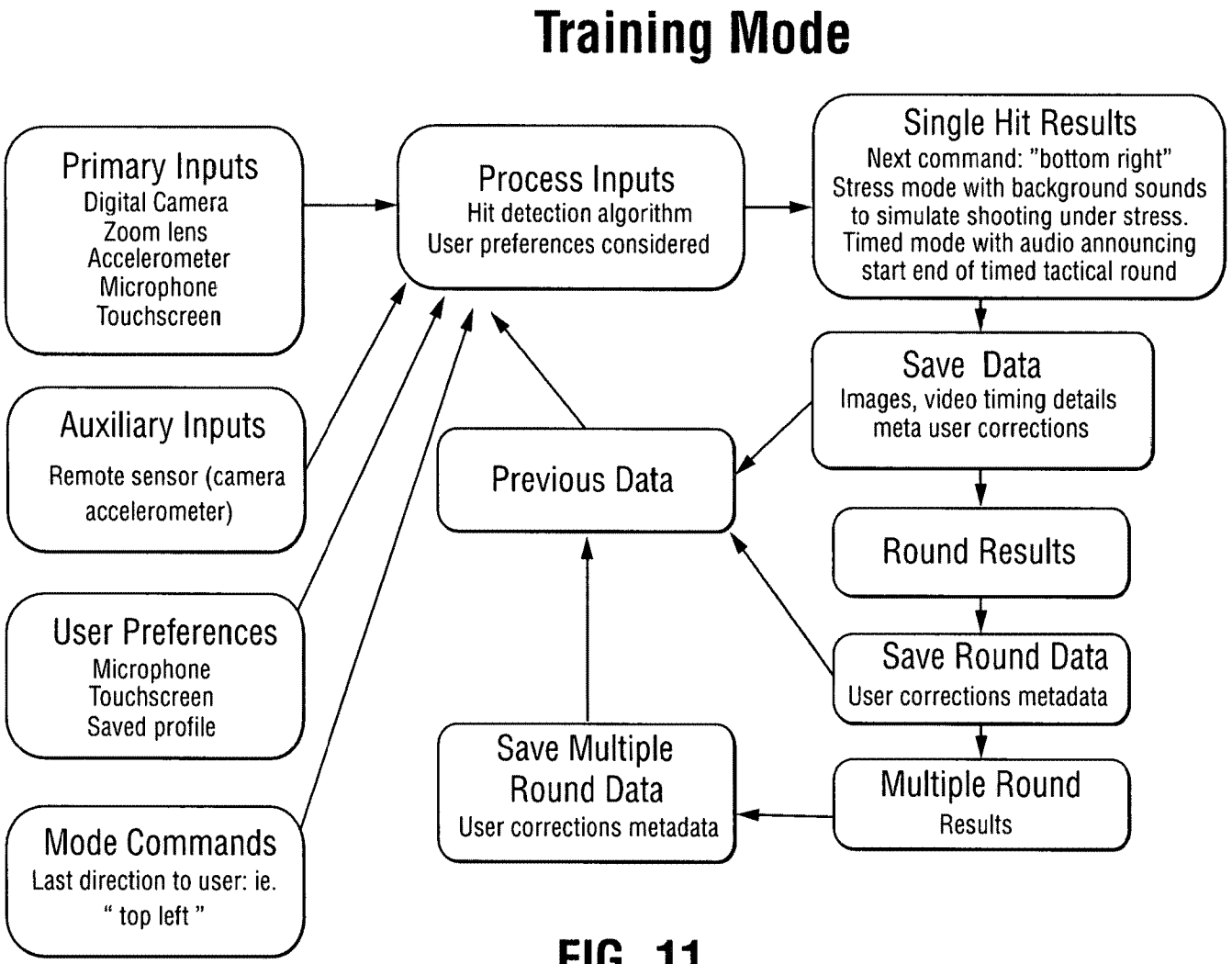
FIG. 11 shows a flow chart depicting the components of the algorithm in Training Mode.
Figure 12:
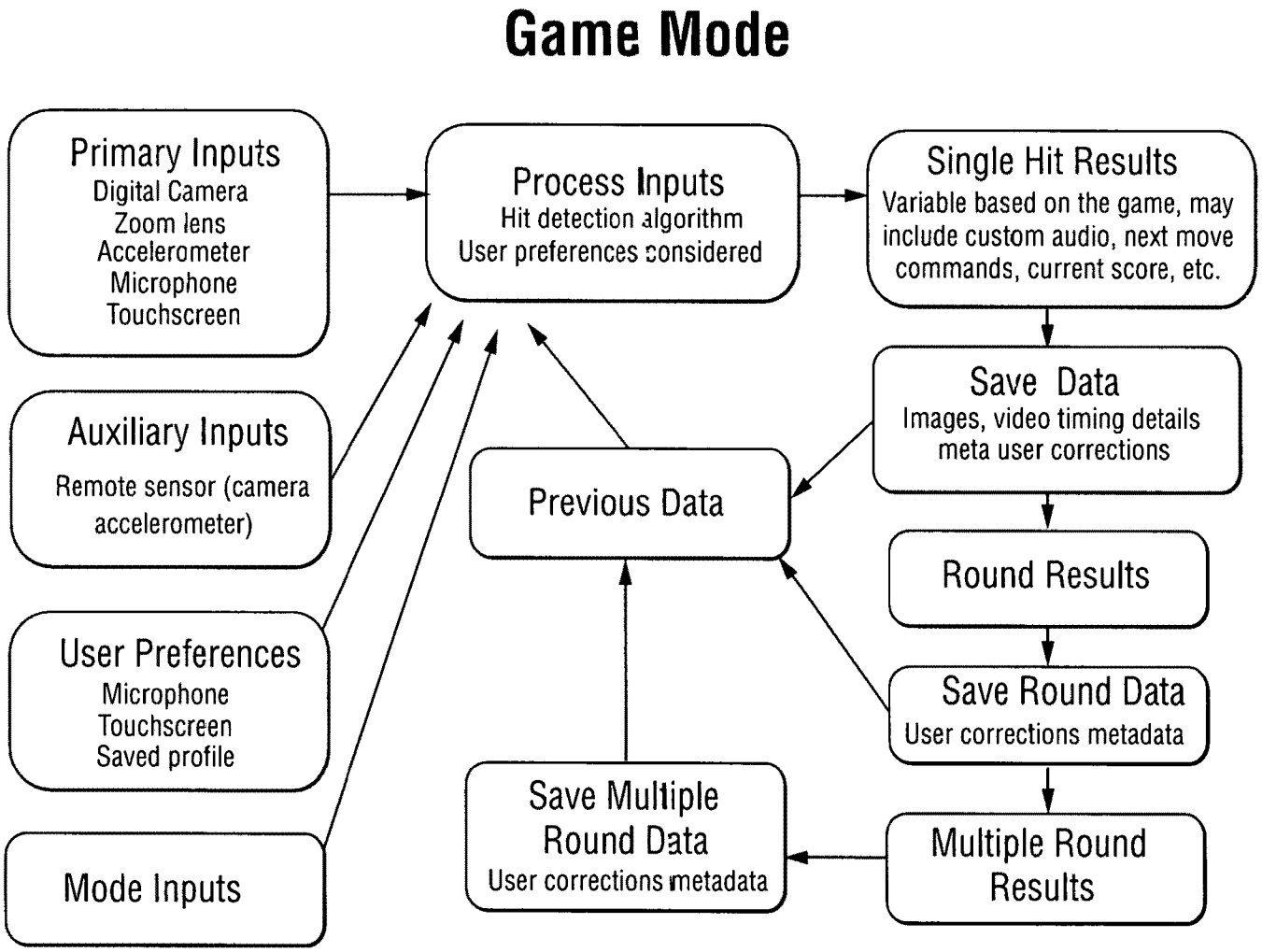
FIG. 12 shows a flow chart depicting the components of the algorithm in Game Mode.

As shown in FIGS. 7-9, the "Multiply Round Output" includes the graphic overlay on the target area, training suggestions based on shot analysis, and the overall round score. For instance in FIG. 7 the application display shows hits inside and outside of the target and the end of round for a user defined period in which the user can quickly and easily review all of their shots which may be color coded to display the shots inside the defined "hit zone" and outside of the defined "hit zone". FIG. 8 illustrates a screen shot wherein the sequence, for example (hit #7 at a time of 2.9 seconds), is shown as "7-2.9" in a first window on the screen. Illustrations depict a second window showing the outside hit shots and inside hit shots by varying graphics, a third window shows the Round Suggestions such as to "take more time between shots", and the fourth window displays the round score, for example: 1) In Hits: 6×2=12, 2); Out Hits: 4×1=4; 3) Groups; 2×3=6; and 4) Total: 22. The application shown in FIG. 8 displays shot analysis during the user defined period, showing shot sequence, time between each shot, shots inside or outside the defined "hit zone", groupings, scoring options, and constructive feedback for better shot placement and groupings. The display depicted in FIG. 9, provides a display of elapsed time playback with user controls allowing cycling through successive or previous shots for more detailed analysis. The display shows the shot analysis during the user defined period utilizing arrows graphing shot sequence shown as broken arrow lines or solid arrow lines based on the time between each shot. The shots inside or outside of the defined hit zone, groupings, scoring options and constructive feed back for better shot placement and/or groupings can be illustrated on the display as well. The present application provides time/sequence arrows, outside hits, inside hits, grouping, playback controls for stepping through graphics for each hit, round suggestions, and round score tallies, the long term score averages, low scores, high scores, suggested areas of training, suggested training exercises, cataloguing of range rounds, and the accuracy of firearms with respect to ammo brands, caliber, bullet weigh, etc.

The method of using the present application involves the following steps:

In the first step, the user chooses between built-in sounds for hit detection. Optionally, the user purchases additional sounds—plink, cannon, bottles, ricochet, large caliber, small caliber, explosions, voice commands/feedback, numbers, or combinations thereof.

The user selects how the sounds will vary between hits to indicate successive hits within a target proximity, hit in new area, hit with short time interval. These effects can accumulate, for example successive hits in the same area within a 5 second interval may produce a sound that continues to increase in pitch.

Another step involves selecting how the sound series may transition into other sounds, for example "plink, plonk, plunk, BOOM". The sounds can indicate distance to center of the target based on pitch, using different sounds or via voice prompts for example "1 inch from center, high, right").

The user may elect the step to display and highlight the most recent and past hits in a round with a bright color or the display can highlight earlier (previous round) hits with a different color.

The user may elect to control some variables to improve the accuracy of hit detection such as caliber, distance to target, region of interest in image, blur, focus, zoom, manually add missed detections, delete invalid detections, and save images of rounds to metadata to enable simulated round playback. The inputs by the user can be utilized by the application to improve the hit detection for the user session or for all user sessions on all devices by transmitting the environment dat back to a centralized server(s) for analysis.

The user may elect the step to remotely control the beginning round, end round, and other actions via Blue tooth controls manually or by voice activation controlled via Blue tooth or device microphone.

The user may elect the process of applying a graphic overlay on the target area during a round including additional details indicating timing intervals, sequence of shots, cluster analysis results, out of zone hits, etc. The graphic overlay utilizes text, arrows, various hit color schemes and other graphic indicators.

For example, during a round the combined result view may use arrows to create a link from a previous shot to the next shot, the arrow can be colored or dashed according to the period of time between the two hits. Hits detected out of the zone will be linked in this chain but will be a selected color such as red while hits in the zone are another selected color such as green. All sequential hits that fall within a user defined grouping (or cluster) limit may have additional rings of another selected color such as orange around the center color. More indicators can be displayed as needed using a set of user controlled check boxes.

During a round a single result view allows the user to toggle through individual hit analysis features. The user may select "History/Sequence" and the hits may be linked with arrows or use color shading to indicate the hit history. The first hit can be black while the last hit is bright green. All hits between will be shaded using a gradient/interpolation calculation.

During a round a single result view can be toggled to grouping and the user can select two points on the display to specific their desired grouping extents. The display will locate one or more groups on the target and shade hits in groups with different colors. If no grouping size is detected, the display will use either the last grouping size inputs or a cluster analysis algorithm.

During a round a single result view can be toggled to target zone mode. The user may specify a target zone or a previous target zone may be used by default. The colors for in zone and out of zone hits will be different.

During a round a single result view can be toggled to timing mode. Text and/or arrow indicators will specify the amount of time between hits and the user may adjust slider bars or other input field to designate thresholds. All hits within the first threshold range may be green, middle range shown in yellow, third range as red.

For a round, a total weighted score can be displayed to the user. This score is a result of several different scoring categories each of which can be adjusted by the user. Standardized and/or preset scoring rules can be used or custom rules can be defined. The scoring categories can include: any hit, in zone hit, distance to center (defined), time between hits, sequence is line, grouping, sequence is triangle, and combinations thereof. For each category, preset thresholds and limits may be used or the user may adjust the values. For the total score, preset weights may be used or the user may adjust the values.

Users can select any number of images as a "virtual target" overlay such as a deer, moose, pumpkin, zombie, dinosaur, or other desired target. The images depicted may be controlled by a holder of the copyright, other ownership of the images, or by state or federal law.

Configurable options apply across most aspects of the product. The user may enter a settings panel to set thresholds, zones, caliber, distance, color choices, sound preferences, etc. These will be saved and used during shooting practice.

Choosing some settings will allow the user to adjust the hit detection algorithm. Choosing caliber, projectile weight, and distance will adjust the behavior of the hit detection algorithm in its criteria for hits and its usage of various image processing routines (image stabilization, image blurring, etc).

Adjusting the distance will also allow the user to control the audio/visual delay for hit detection. Choosing a longer distance can add the audio delay associated with the speed of sound.

Reflective dot sticker attached to target (top corner, bottom corner, etc). Individual hits in defined target zone will cause the camera to use the flash and the light will be reflected from the sticker. Multiple hits can cause the camera to flash patterns of lights. Shooter can receive both visual and audio feedback.

For a nearby cue, a mirror next to or attached to phone/tablet will reflect camera flash back to user when individual hits in defined target zone are made. Multiple hits can cause the camera to flash patterns of lights. The shooter can receive both visual and audio feedback.

The application can also determine the areas of interest on targets without user input if specially designed targets with fiducials are used. The algorithm can detect the fiducials and their positioning and match them to a database which will identify the mode, target type, game, etc. for the application to support for this session.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples all percentages are given on a weight basis unless otherwise indicated.

Mode Examples

The present invention provides various modes of uses which include selected features for particular applications.

Freestyle Mode

The freestyle mode allows shooter to freely "plink" at targets while gaining audio feedback on hit in designated target area. Customizable sound feedback at the discretion of the user. It also allows shooter to utilize any number of the specific features within the "features list" or choose no analytics and just shoot for fun.

Practice Mode

The practice mode allows shooter to provide detailed inputs (firearm make/model, caliber, bullet weight, ammo brand/type, target distance, designated target area, etc) with the algorithm capturing data for post shot, round and multi-round analysis and feedback. Audio feedback on the shooter such as jerking the trigger, left hand, over gripping—right hand, breaking the wrist up—left hand; are available as suggestions.

Training Modes

The training modes include the moving target mode wherein the voice audio commands direct where to hit such as "top left", "bottom right" with increasing/adaptable speed levels. The stress mode provides various background sounds to simulate shooting under duress. The timed mode provides sounds announcing the start and end or a round for timed tactical training.

Game Modes

With or without target displays, the user may choose to play games such as "tic-tac-toe", "smiley face", "Simon says", or custom branded modes such as HICKOK45 Mode. For instance, "tic tac toe" may use a custom printed target. The game may be single player or versus a computer. Single player wins each time three (3) hits are made in the grid horizontally, diagonally or vertically. "Smiley face" allows the image processing application to judge the quality of a minimum of 5 shots to form a smiley face. "Simon says" provides a verbal list of shots on a printed grid. A 4×4 grid may be numbered 1 through 16. The voice prompt will command "9-8-2-15" and the user must hit these numbers in sequence. Grid size, command length and other variables can be adjusted by the user. One mode within the branded HICKOK 45 game set is a mode using a custom target representing various metal targets, glass targets, clay targets and fruit. Hits will be detected and the audio will produce the corresponding hit sounds (glass breaking, metal plinks, etc). This mode may feature custom audio from an actor suggesting targets or may be freestyle.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

We claim:

1. An electronic audible feedback projectile targeting system, consisting of:

a device for shooting projectiles;

a target with an impact sensor attached thereto;

said target is selected from the group consisting of a metallic target, a paper target, a target worn on by a paint ball player, and combinations thereof;

said impact sensor for sensing an impact of said projectile is with an impact sensor selected from the group consisting of a piezoelectric sensor, an electromagnetic sensor, a 3 axis accelerometer, a capacitive sensor, and an inductive sensor for detecting hits from a bullet, an air soft pellet, and air gun pellet, and an arrow;

a wireless transmitter electrically connected to said impact sensor, said wireless transmitter selected from the group consisting of radio frequency transmissions and infra-red transmissions transmitting a wireless message with impact describing data said wireless transmitter transmitting a pre-selected sound and/or visual signal to a receiver upon said projectile impacting said target transmitting impact describing audible and/or visual data therefrom;

a receiver selected from the group consisting of a smart phone, a tablet, a watch and combinations thereof including software and hardware receiving said wireless message with impact describing data from said transmitter providing an impact describing audible and/or visual message to a user, said impact describing audible message being interpreted from said impact describing data, said receiver comprising a radio frequency receiver receiving a wireless message comprising a radio frequency transmission with application software enabling said receiver to receive a target impact describing audible and/or visual data transmission from said wireless transmitter;

a hit detection algorithm software application enabling said receiver to interpret said target impact describing audible data containing target impact data, detecting a hits on said target, detecting a miss of said target, recording a hit data, accumulating hit data from single shots and multiple shots for calculating performance, and detecting most recent hits and previous hits;

means of inputting user preferences and interpreting hit or miss data with said hit detection algorithm, wherein said means is selected from a group of primary input devices consisting of a digital camera, digital camera with zoom lens, an accelerometer, a microphone, a touchscreen, and combinations thereof;

said user preferences and said hit or miss data selected from the group consisting of distance impact is from a center of said target, a sound which mimics an impact of a hit on a selected material, a sound which mimics a hit or miss of said target, a sound mimicking an exaggerated impact, a sound which is indicative of a distance said target is from a shooter;

said receiver providing an impact describing audible message to a user and interpreting the impact describing audible message and said user preferences providing a recognized audible sound selected from the group consisting of a sound made by a selected gun, a bullet, an arrow, a sound made in accordance of a distance the target is from the shooter, a sound made in accordance with the type of material comprising said target, a hit of said target, a miss or said target; and said impact describing transmission being interpreted from said impact describing said hit or miss data showing or replaying said hit whereby said algorithm detects said hit on said target, said miss of said target, differentiate between a prior hit and a most recent hit with a selected color or different shade, and provide a sound and/or visual feedback which varies depending on where said projectile hits said target.

2. The electronic audible feedback bullet targeting system of claim 1 wherein said receiver and said transmitter transmits data using Bluetooth format and said receiver includes a radio frequency transmitter and RF receiver with application software enabling said receiver to provide audible messages containing target impact data.

3. The electronic audible feedback bullet targeting system of claim 1 wherein a type of said impact describing data is selected from the group consisting of target identification, degree of impact, a hit in the target area, an intensity of said hit, a location of a hit within said target.

4. The electronic audible feedback bullet targeting system of claim 1 wherein an audible sound is selected from the group of sounds consisting of a sound produced from firing a selected gun, a sound which is indicative of a distance the impact is from the center of said target, a sound which mimics an impact of a hit on a selected material comprising the target, a sound mimicking an exaggerated impact, a sound which is indicative of a distance.

5. The electronic audible feedback bullet targeting system of claim 1 wherein said hit detention algorithm software application comprises an image processing program augmented with at least one cue from an accelerometer, a microphone, a touchscreen device and combinations thereof.

6. The target impact sensing system of claim 1 said receiver providing an impact describing visual message to said user.

7. An electronic audible feedback projectile targeting system, consisting of:

a device for shooting projectiles;

a target with an impact sensor attached thereto;

said target is selected from the group consisting of a metallic target, a paper target, a target worn on by a paint ball player, and combinations thereof;

said impact sensor for sensing an impact of said projectile is with an impact sensor selected from the group consisting of a piezoelectric sensor, an electromagnetic sensor, a 3 axis accelerometer, a capacitive sensor, and an inductive sensor for detecting hits from a bullet, an air soft pellet, and air gun pellet, an arrow, and combinations thereof;

a wireless transmitter electrically connected to said impact sensor, said wireless transmitter and a receiver transmitting data using Bluetooth format transmitting a wireless message with impact describing data said wireless transmitter transmitting a pre-selected sound to a receiver upon said projectile impacting said target transmitting impact describing audible and/or visual data therefrom;

a receiver selected from the group consisting of a smart phone, a tablet, a watch and combinations thereof including software and hardware receiving said wireless message with impact describing data from said transmitter providing an impact describing audible and/or visual message to a user, said impact describing audible and/or visual message being interpreted from said impact describing data, said receiver comprising a radio frequency receiver receiving a wireless message comprising a radio frequency transmission with application software enabling said receiver to receive a target impact describing audible and/or visual data transmission from said wireless transmitter;

a hit detection algorithm software application enabling said receiver to interpret said target impact describing audible data containing target impact data, detect hits on said target, detect misses of said target, record hit data, accumulates hit data from single shots and multiple shots for calculating performance, detect most recent hits and previous hits;

means of inputting user preferences and data for said hit detection algorithm, wherein said means is selected from a group of primary input devices consisting of a digital camera, digital camera with zoom lens, an accelerometer, a microphone, a touchscreen, and combinations thereof;

said user preferences selected from the group consisting of distance impact is from a center of said target, a sound which mimics an impact of a hit on a selected material, a sound mimicking an exaggerated impact, a sound which is indicative of a distance said target is from a shooter;

said receiver providing an impact describing audible message to a user and interpreting the impact describing audible and/or visual message and said user preferences providing a recognized audible sound selected from the group consisting of a sound made by a selected gun, a bullet, an arrow, a sound made in accordance of a distance the target is from the shooter, a sound made in accordance with the type of material comprising said target, a sound made by a hit of said target, a sound made by a miss or said target; and said impact describing transmission being interpreted from said impact describing data showing or replaying said hit whereby said algorithm detects said hit on said target and differentiates between a prior hit and a most recent hit with a selected color on a screen of said receiver or a miss of said target, and provide a sound and/or visual feedback which varies depending on where said projectile hits said target.

8. The target impact sensing system of claim 7 said receiver providing an impact describing visual message to said user.

9. A target impact sensing system consisting of:

a device for shooting projectiles; a shooting target sensing an impact of a projectile selected from the group consisting of a metallic target, a paper target, a target worn on by a paint ball player, and combinations thereof with an impact sensor selected from the group consisting of a piezoelectric sensor, an electromagnetic sensor, a 3 axis accelerometer, a capacitive sensor, and an inductive sensor;

a wireless transmitter electrically connected to said impact sensor, said wireless transmitter transmitting a wireless message selected from the group consisting of radio frequency transmissions and infra-red transmission with impact describing data;

said wireless transmitter transmitting a pre-selected sound and/or visual transmission to a receiver upon said projectile impacting said target said wireless transmitter using Bluetooth format and said receiver includes a radio frequency transmitter and RF receiver with application software enabling a receiver to receive an audible and/or visual transmission from said wireless transmitter;

said receiver selected from the group consisting of a smart phone, a tablet, a watch and combinations thereof receiving said wireless transmission with impact describing data from said wireless transmitter providing an impact describing audible and/or visual transmission to a user, said impact describing audible and/or visual transmission being interpreted from said impact describing data;

a hit detection algorithm software application enabling said receiver to interpret said target impact describing audible and/or visual transmission containing target impact data selected from the group consisting of detecting hits on said target, detecting misses of said target, recording hit data, accumulating hit data from single shots and multiple shots for calculating performance, detecting most recent hits and detecting previous hits and providing audio and/or visual displays of said hits to said receiver;

an audible sound produced from said hit detection algorithm selected from the group of sounds consisting of a sound produced from firing a selected gun, a sound which is indicative of a distance the impact is from the center of said target, a sound which mimics an impact of a hit on a selected material comprising the target, a sound mimicking an exaggerated impact, a sound which is indicative of a distance said target is from a shooter, a sound indicating a target miss, and combinations thereof.

10. The target impact sensing system of claim 9 said receiver providing an impact describing visual message to said user.

* * * * *